US005788893A

United States Patent [19]

Montagnino et al.

[11] Patent Number: 5,788,893

[45] Date of Patent: Aug. 4, 1998

[54] COOLMIST HUMIDIFIER WITH VOLUTE VAPOR FLOW PASSAGEWAY

[75] Inventors: James Montagnino, El Paso, Tex.; Wyley Kitzmiller, 7321 Tierra Alta, El Paso, Tex. 79912

[73] Assignees: Production Engineered Designs, Inc.; Wyley Kitzmiller, both of El Paso, Tex.

[21] Appl. No.: 741,171

[22] Filed: Oct. 29, 1996

[51] Int. Cl.[6] ..... B01F 3/04

[52] U.S. Cl. ..... 261/91

[58] Field of Search ..... 261/91

[56] References Cited

U.S. PATENT DOCUMENTS

| | | | |
|---|---|---|---|
| 1,979,630 | 11/1934 | Lea | 261/91 |
| 2,078,202 | 4/1937 | Manning | 261/91 |
| 2,631,833 | 3/1953 | De Vilbiss | 261/91 |
| 3,188,007 | 6/1965 | Myklebust | 261/91 |
| 3,290,021 | 12/1966 | Blachly et al. | 261/91 |
| 3,528,781 | 9/1970 | Gelfman et al. | 261/91 |
| 5,034,162 | 7/1991 | Chiu | 261/91 |
| 5,397,510 | 3/1995 | Clark | 261/91 |

FOREIGN PATENT DOCUMENTS

| | | | |
|---|---|---|---|
| 491332 | 8/1938 | United Kingdom | 261/91 |

*Primary Examiner*—Tim R. Miles

*Attorney, Agent, or Firm*—Watson Cole Grindle Watson, P.L.L.C.

[57] ABSTRACT

A coolmist humidifier appliance which emits liquid in the form of mist or fog to achieve enhanced humidification includes a lower housing part which is positionable on a support surface and an upper housing part which is removably positionable on the lower housing part and includes a motor and an impeller assembly for drawing liquid upwardly from the lower housing part and spraying it radially outwardly against a ring of comb teeth so as to form liquid droplets outside of the ring of comb teeth. The upper housing part includes a discharge opening and a guide wall which extends downwardly toward the lower housing part and toward the discharge opening along a spiral curve so that the liquid droplets will move toward the discharge opening along a volute passageway.

10 Claims, 11 Drawing Sheets

COOLMIST HUMIDIFIER WITH VOLUTE VAPOR FLOW PASSAGEWAY

BACKGROUND OF THE INVENTION

1. Field of the Invention

The invention relates to humidifier appliances which create and discharge liquids such as water as vapor into an enclosed area or room, and in particular, to such humidifiers which operate without boiling the liquid, i.e., coolmist-type humidifiers.

2. The Prior Art

Coolmist-type humidifier appliances are well known and rather popular because they create a vapor mist quickly and with low power consumption. They are also safer than humidifiers which rely on boiling liquids insofar as heater elements are avoided. A humidifier of this type is disclosed, for example, in U.S. Pat. No. 3,290,021.

The present invention provides a coolmist-type humidifier appliance wherein the vapor created therewithin is caused to flow in an improved fashion to the vapor discharge outlet, thus increasing the efficiency of the unit. According to the present invention the humidifier appliance provides a volute passageway, i.e., a passageway of increasing cross-sectional dimensions through which the vapor created within the appliance flows as it moves towards a vapor discharge opening. Due to the use of such a volute passageway, the vapor discharged from the appliance will have finer liquid droplets than in currently known units; indeed, the droplets will be sufficiently fine that the vapor will be in the form of a visible mist or fog similar to that emitted by an ultrasonic-type humidifier. This vapor will provide excellent room humidification. The volute passageway can be either defined in part by a surface of the liquid in the appliance being vaporized, such that the cross sectional area of the volute passageway will be influenced by the changing level of liquid in the appliance, or the dimensions of the volute passageway can be independent of the liquid contained in the appliance and thus not affected by a changing liquid level.

Further features and advantages of the invention will become apparent by reference to the attached drawings taken in conjunction with the following discussion.

DETAILED DESCRIPTION OF THE PREFERRED EMBODIMENTS

Figure 8:
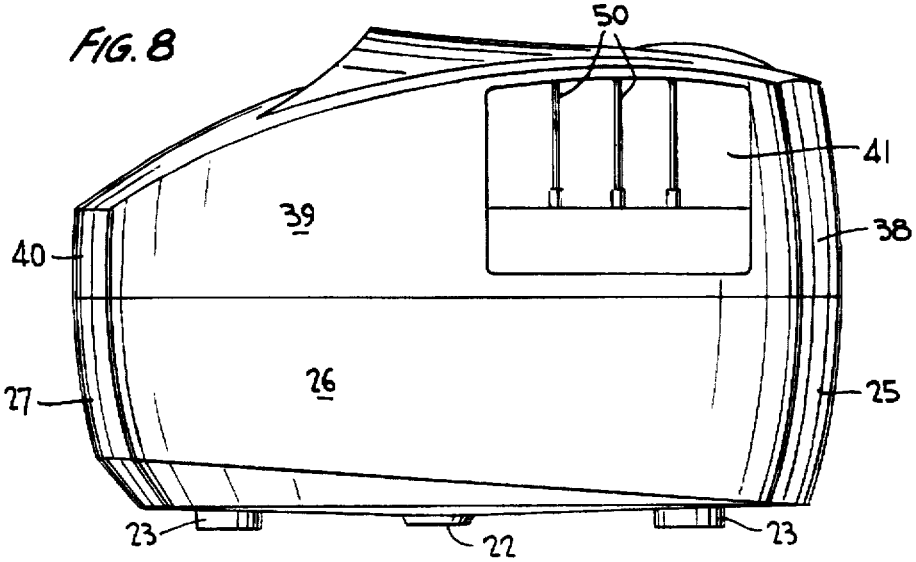
FIG. 8 is a side elevational view, the grid element and air filter covering the air inlet opening being removed.
Figure 9:
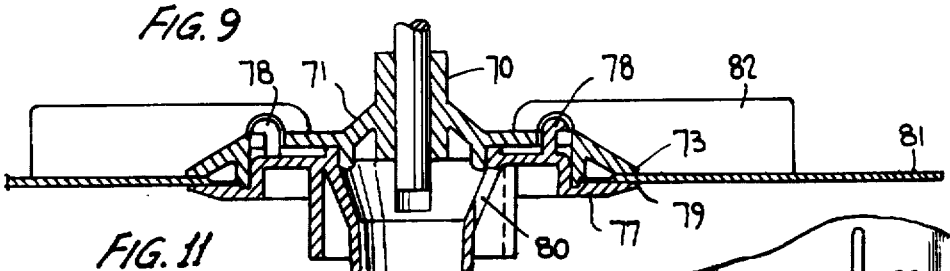
FIG. 9 is an enlarged cross sectional view of the impeller assembly therein.

A humidifier appliance 10 constructed in accordance with a first preferred embodiment of the present invention, i.e., wherein a changing surface level of liquid to be evaporated forms the bottom of the volute passageway for the vapor moving towards a vapor discharge opening, is shown in FIGS. 1–15. It includes a lower housing part 20 and an upper housing part 30, the lower housing part constituting a tank for the liquid to be vaporized and the upper housing part containing the elements operative to create and discharge the liquid as vapor. In the following description the terms top, bottom, upper, lower, upwardly, downwardly, inner and outer will be used on the assumption that the described elements are operatively connected together and the humidifier appliance is operatively positioned on a horizontal supporting surface as shown in FIG. 8.

The lower housing part 20, which in plan view has a generally rectangular configuration, includes a bottom wall 21 (see FIG. 3) which is slightly downwardly inclined towards a substantially centrally located and rather shallow well 22, and side walls 24–27 (see FIGS. 3, 4, 6 and 8) which extend upwardly from the outer edges of the bottom wall to provide a reservoir for the liquid to be vaporized. The upper edges of the side walls are stepped so that, in conjunction with upper portions of spaced brackets 28 located internally of the side walls (see FIGS. 4 and 6), channels are provided for locating side walls of the outer shell of the upper housing part 30. Feet 23 are provided beneath the bottom wall 21 for positioning the bottom wall (and its well 22) above a supporting surface such as a table top.

The upper housing part 30, which in plan view has a generally rectangular configuration and size identical to the lower housing part, includes an outer shell 31, a drive motor 55, a manifold element 60 and an impeller assembly 70.

As can be seen from FIGS. 1, 2, 3, 5 and 12, the outer shell 31 includes a top outer wall 32 which is contoured to provide a curved trough 33 leading to an elongated liquid inlet opening 34 near a rear corner of the outer shell, and a curved elevated duct 35 which increases in height (relative to the surrounding portions of the top wall) and width as it extends to a sloped vapor discharge opening 36 located near a front corner of the outer shell diagonally opposite the liquid inlet opening 34. Side walls 37–40 extend downwardly from the edges of the top wall to lower edges that extend into the channels provided by the side walls 24–27 and the brackets 28 of the lower housing part, i.e., when the upper housing part is positioned on the lower housing part. An inlet opening 41 for air, covered by a grid element 42 and an air filter 42*a* (see FIGS. 2 and 12), is provided in the side wall 39 near the rear of the outer shell (see also FIG. 8).

Figure 2:
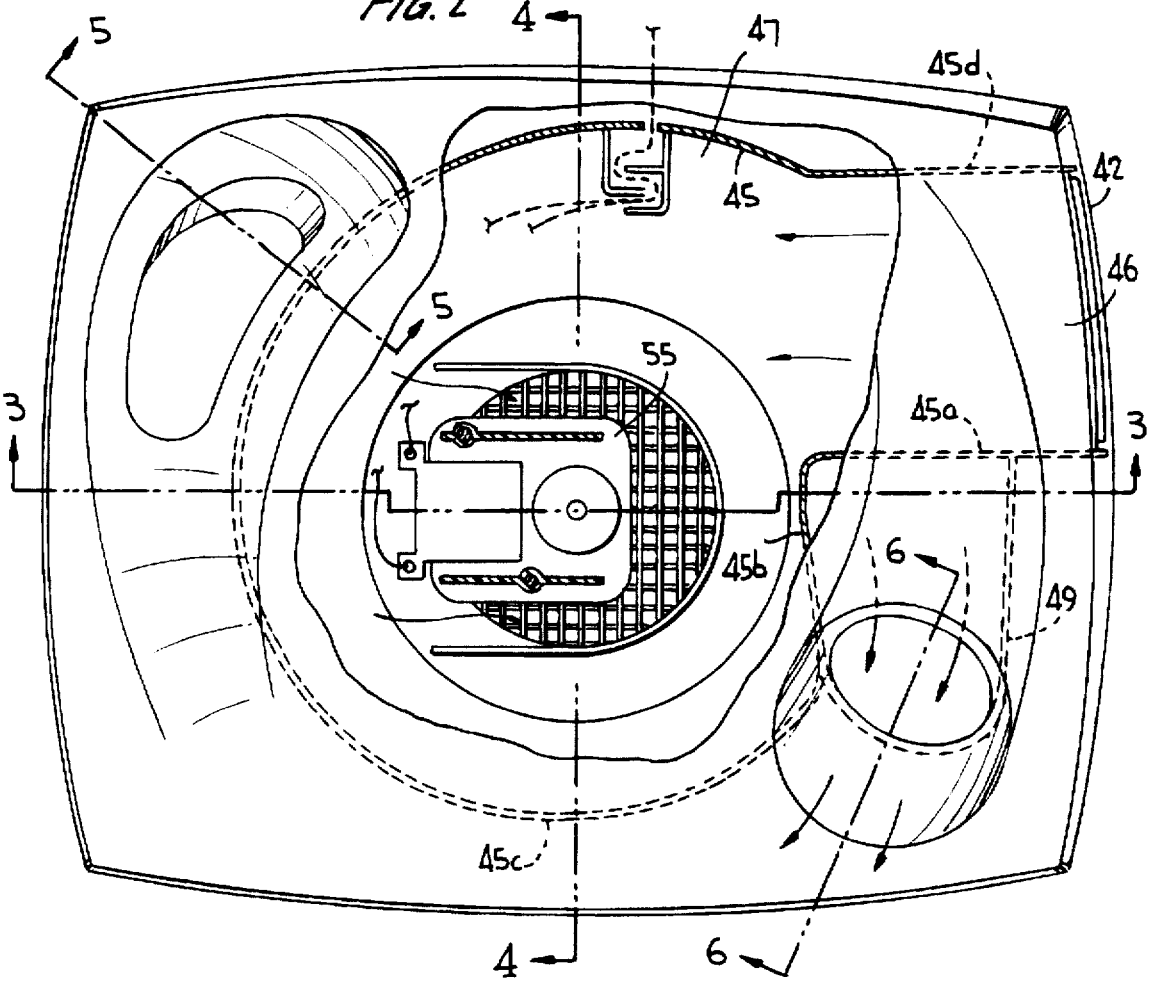
FIG. 2 is a top plan view thereof, a center portion being broken away to illustrate internal elements in the upper housing part thereof.
Figure 3:
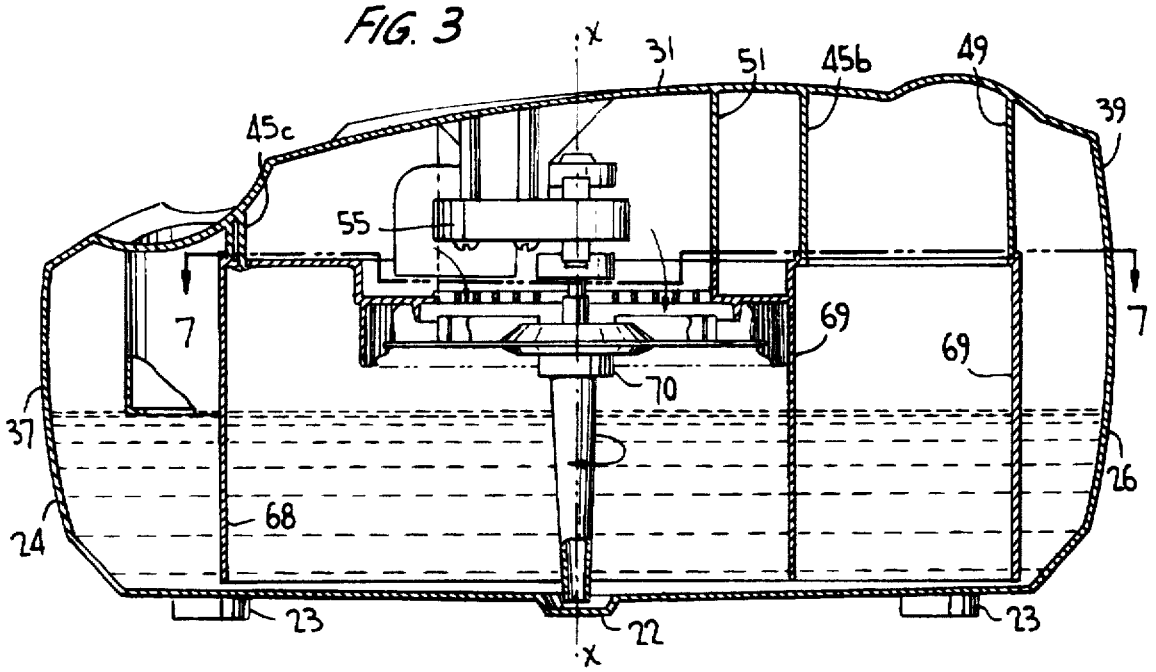
FIG. 3 is a cross sectional view of the humidifier appliance as seen along line 3—3 in FIG. 2.
Figure 4:
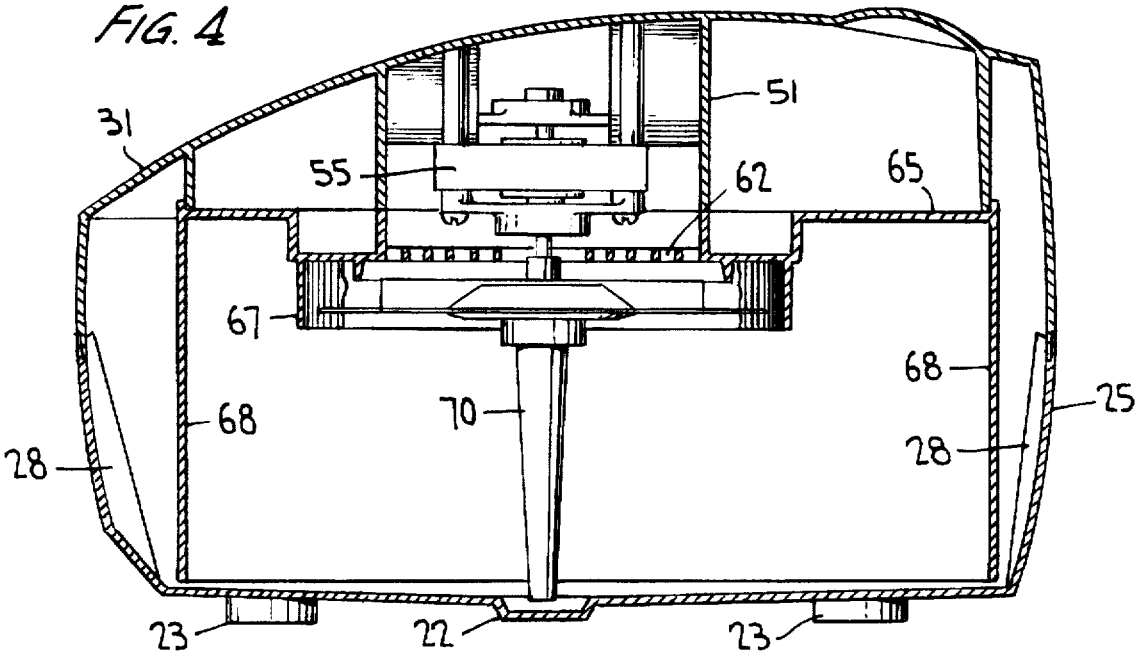
FIG. 4 is a cross sectional view thereof as seen along line 4—4 in FIG. 2.
Figure 7:
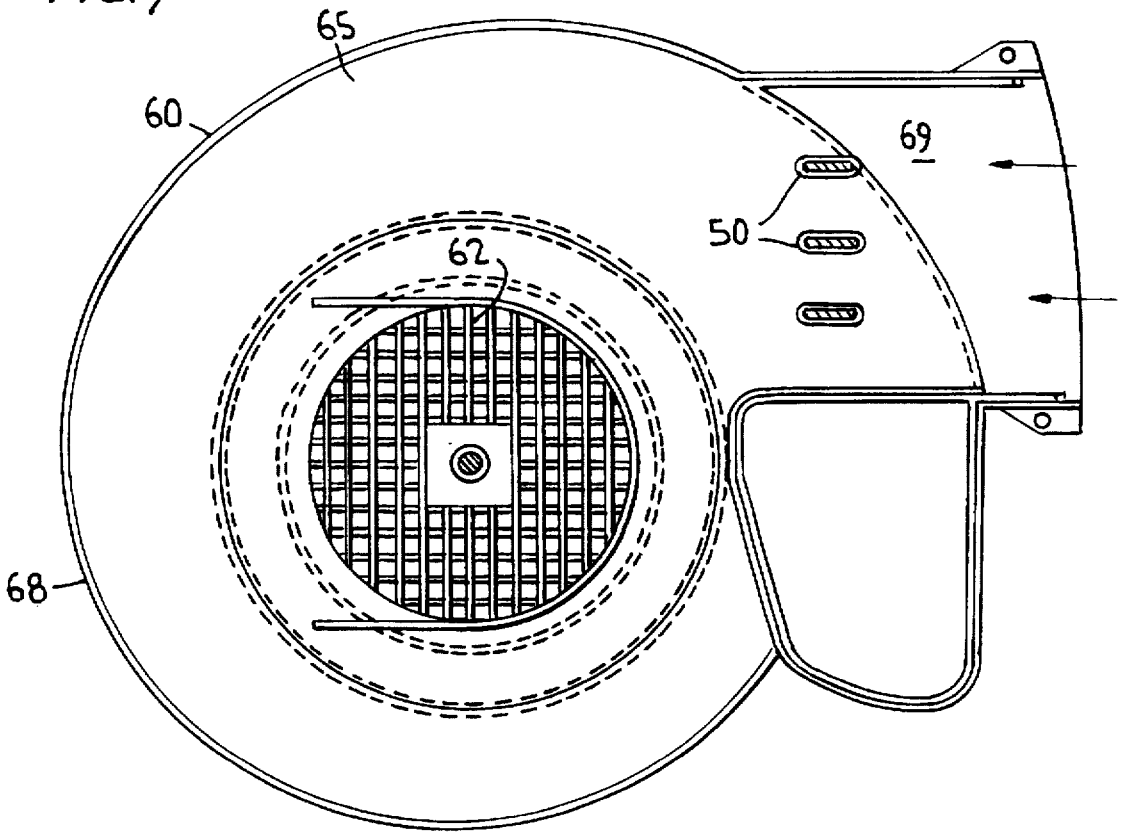
FIG. 7 is a cross sectional view thereof as seen along line 7—7 in FIG. 3.
Figure 12:
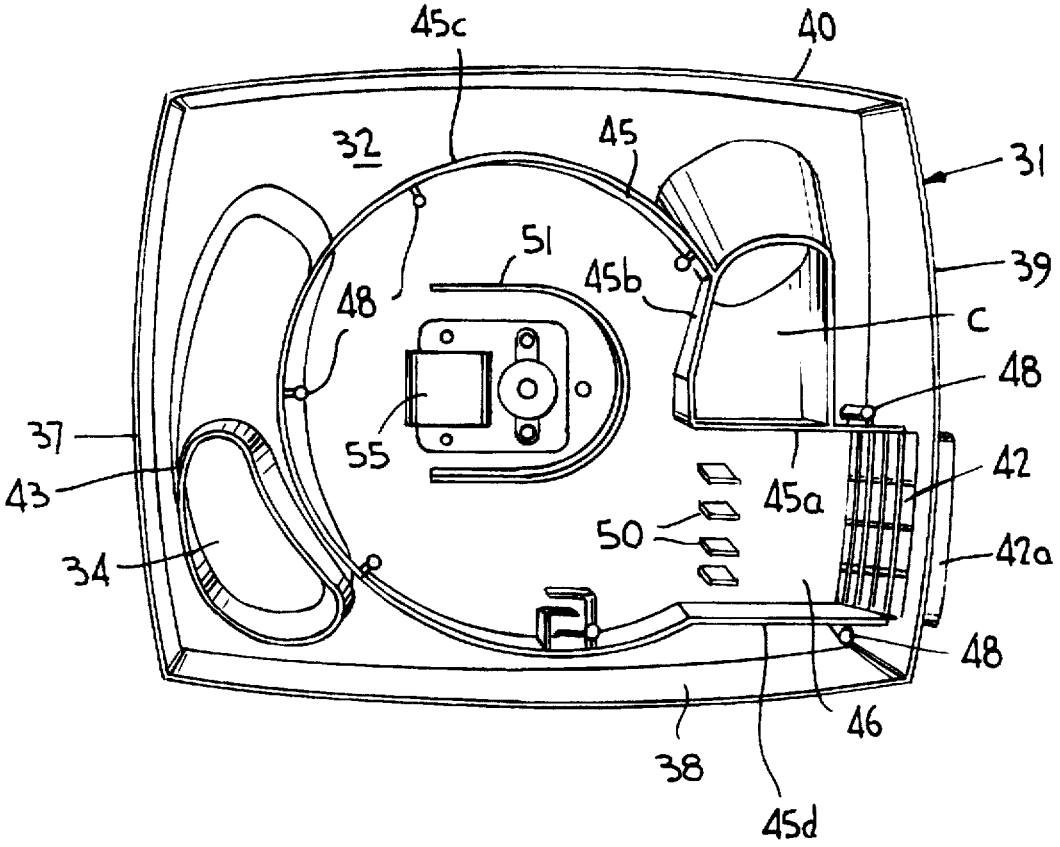
FIG. 12 is a bottom perspective view of the outer shell of the upper housing part with attached drive motor.

The outer shell 31 also includes an internal wall 43 which extends downwardly from the periphery of the liquid inlet opening 34 so as to guide liquid to be vaporized downwardly from trough 33 into the lower housing part. In addition, outer shell 31 includes a plurality of motor mounts 44 which extend downwardly from a central portion of the top wall to mount the drive motor 55 such that a drive shaft 56 of the drive motor will extend downwardly towards the well 22 of the lower housing (along an imaginary axis X). As best seen in FIGS. 2 and 12, a guide wall 45 extends downwardly from the top wall to help guide air flowing into the upper housing through opening 41, the guide wall including a straight first portion 45*a* extending from one side of the opening 41 towards a center area beneath the top wall, a second portion 45*b* which extends towards an inner side of the discharge opening 36, a curved third portion 45*c* which curves from second portion 45*b* around the imaginary axis X with increasing radius, and a straight fourth portion 45*d* which extends parallel with the first portion 45*a* to help define an air intake channel 46 leading into an air chamber 47 (see FIG. 2). Screw mounts 48 are located inside the third portion 45*c* and outside the first and fourth portions 45*a*, 45*d* for attachment of the manifold element 60. A further guide wall 49 extends downwardly from the top wall and extends from an outer side of the discharge opening 36 to the first portion 45*a* so that, together with the first portion 45*a* and the second portion 45*b*, an upwardly-extending vapor discharge chute C leading to vapor discharge opening 36 is provided. Guide vanes 50 extend downwardly from the top wall into the air intake channel 46 to control air flow, and a U-shaped barrier wall 51 extends downwardly from the top wall to partially surround the drive motor 55 when connected to the motor mounts 44, the curved portion of the barrier wall facing the guide wall portion 45*b* (see FIG. 2). This barrier wall causes air entering the air intake channel to be drawn across the motor coil for maximum cooling and to reduce motor noise emitted from the air inlet opening 41.

Figure 1:
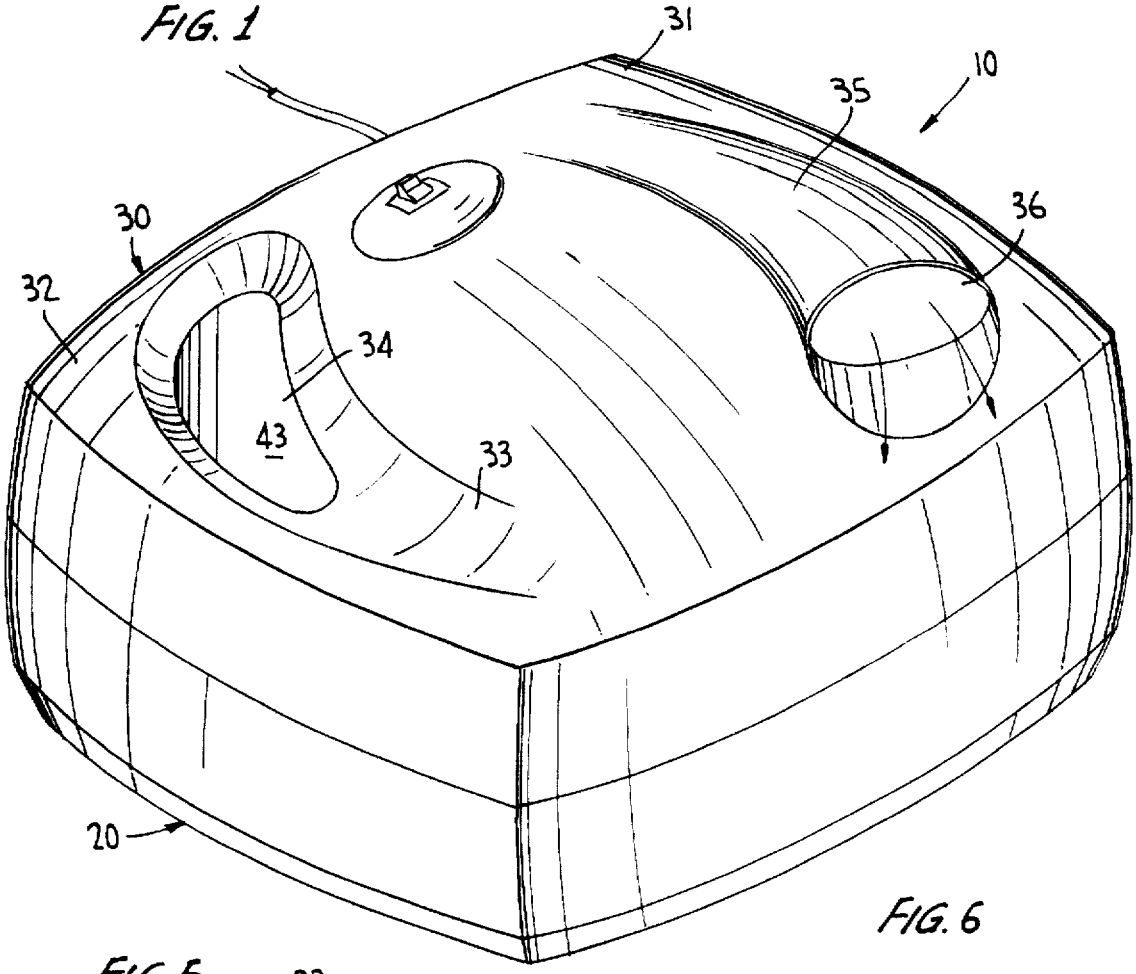
FIG. 1 is a perspective view of a humidifier appliance constructed in accordance with a first embodiment of the present invention.
Figure 5:
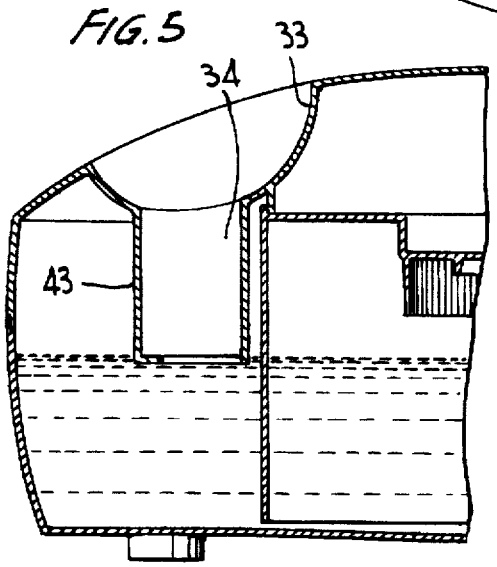
FIG. 5 is a cross sectional view thereof as seen along line 5—5 in FIG. 2.
Figure 6:
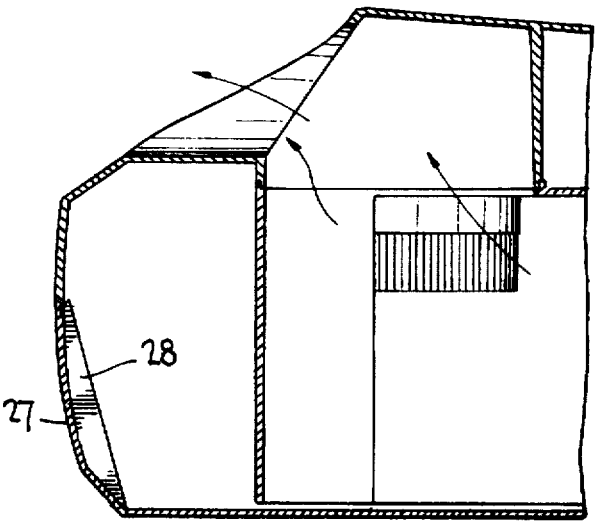
FIG. 6 is a cross sectional view thereof as seen along line 6—6 in FIG. 2.

The drive motor 55 is electrically connected to a power source through a switch assembly 57 mounted in the top wall 32 (see FIG. 1).

Figure 13:
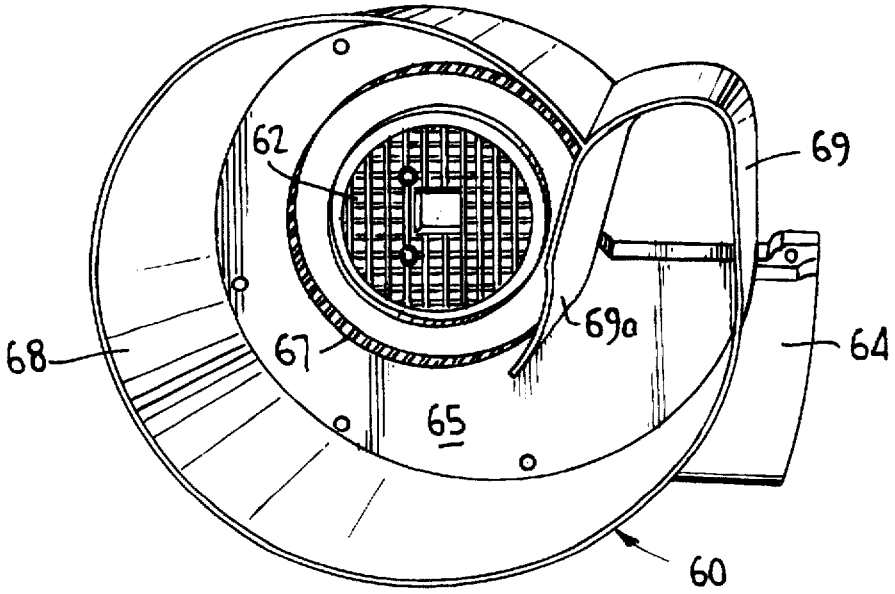
FIG. 13 is a bottom perspective view of the manifold element of the upper housing part.
Figure 14:
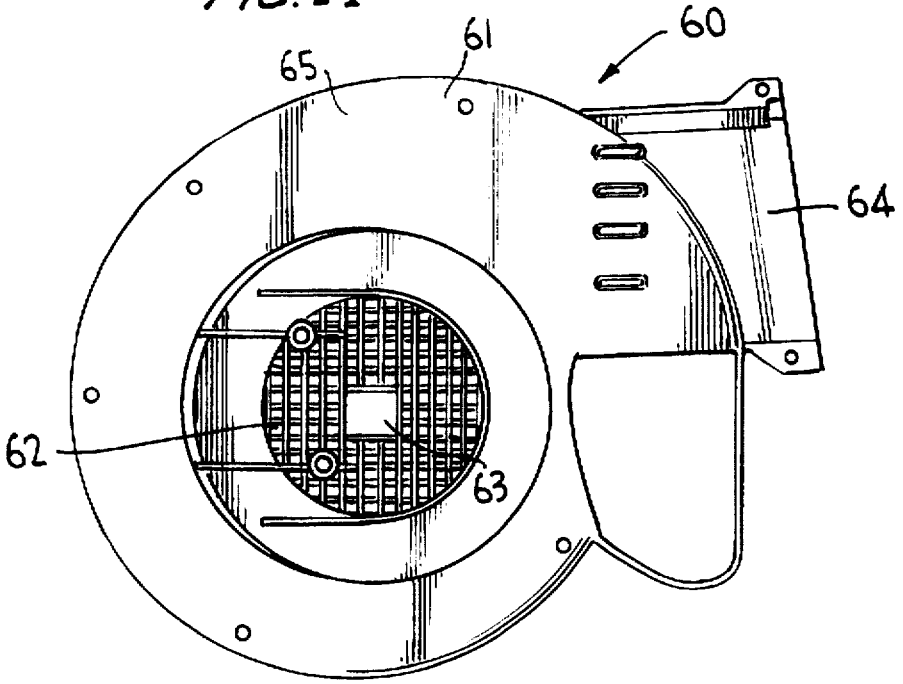
FIG. 14 is a top perspective view of the manifold element of FIG. 13.
Figure 15:
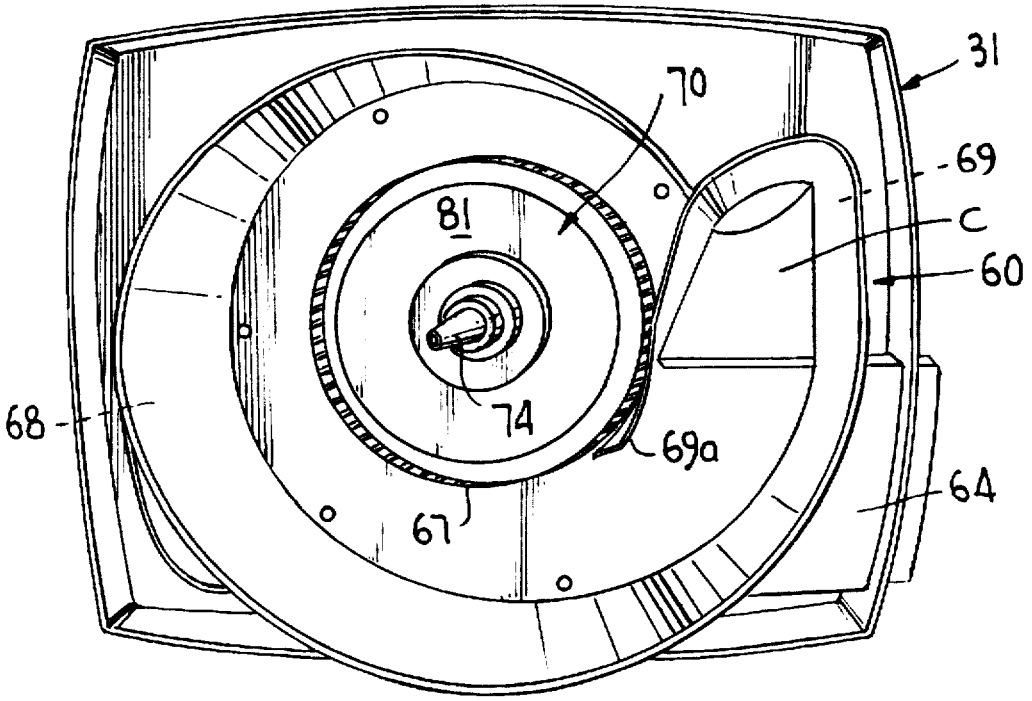
FIG. 15 is a bottom perspective view of the upper housing part when all elements thereof are connected together.

The manifold element 60, best understood from FIGS. 13 and 14, includes a top portion 61 that defines a circular screen 62 having a central opening 63 for the drive motor shaft 56, a U-shaped chute portion 64 and an intermediate wall portion 65 which extends from the periphery of the screen 62 to the chute portion 64, its outer edge being curved and having an increasing diameter as it extends from an inner edge of the chute portion around to the outer edge thereof. A ring 67 of comb teeth extends downwardly from the intermediate wall portion 65 around the screen 62. In addition, the manifold element includes a depending side wall 68 which extends downwardly from the outer edge of the intermediate wall portion 65 and includes a generally U-shaped terminal portion 69 which extends beneath and beyond the chute portion 64, the sides of this terminal U-shaped portion 69 being registerable with the guide wall portion 45*b* and guide wall 49 of the outer shell 31. The U-shaped portion 69 has a free end 69*a* which is curved towards the ring 67 of comb teeth. The manifold element 60 is attached to the outer shell 31 via screws extending through holes in the wall portion 65 and into screw mounts 48. When attached to the outer shell 31, the intermediate wall portion 65 provides a bottom to air chamber 47 and the chute portion 64 provides a bottom to air intake channel 46. The screen 62 enables air from the air chamber 47 to be sucked downwardly towards the impeller assembly 70 and the upper surface of the liquid in the lower housing therebelow. When the upper housing 30 is positioned on the lower housing 20, the side wall 68 will extend almost to the bottom wall 21 (see FIG. 4).

The impeller assembly 70 includes a central hub 71, a liquid pickup element 74 and an air swirl disk 81. The central hub 71 is connected to the drive motor shaft 56, and it includes curved slots 72 with lips 72*a* and a peripheral edge 73. The liquid pick up element 74 includes a downwardly-extending tube 75 and a connection flange 77 that provides latches 78 that can fit within the slots 72 of the central hub 71 (to enable bayonet connection when rotated over lips 72*a*) and a peripheral edge 79. A liquid discharge opening 80 is provided at the top of the tube 75. The air swirl disk 81, which is removably clamped between the peripheral edges 73 and 79, includes radially-extending vanes 82 for creating air swirls when rotated. The tube 75 extends downwardly to a bottom mouth 75*a* located in well 22.

Figure 11:
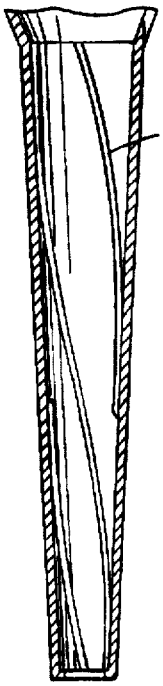
FIG. 11 is a partial cross sectional view of an alternative suction tube usable in the impeller assembly of FIG. 10.
Figure 11:
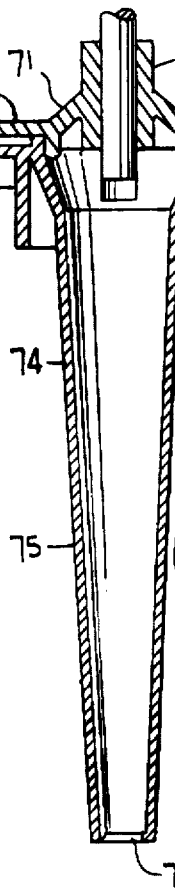
Figure 10:
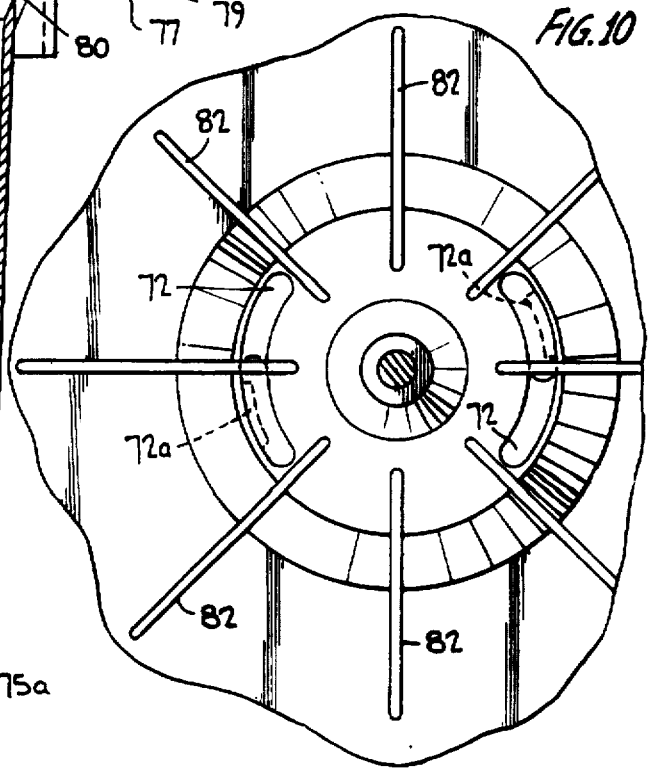
FIG. 10 is a partial top plan view of the impeller assembly.

As shown in FIG. 11, the tube 75 can include helical vanes 76 therein to assist in liquid uptake to discharge opening 80.

With the humidifier appliance assembled and filled with liquid via trough 33 and opening 34, it operates as follows. The drive motor 55 rotates the impeller assembly 70 (clockwise in FIG. 1), so that it will cause liquid from well 22 in the lower housing part to flow upwardly within its pickup tube, radially out of the water outlet 80 and along the lower surface of the disk 81 to its periphery, where it becomes contained in a swirling air flow caused by the rotation of vanes 82. The liquid will be thrown against the ring 67 of comb teeth and broken into smaller droplets, and droplet-containing air provided radially outwardly of the ring of comb teeth will be caused to flow within and along the three-sided volute passageway portion of increasing dimensions defined by curved side wall 68, intermediate wall portion 65 and the liquid surface within lower housing 20, and then along the four-sided volute passageway portion defined by the free end 69*a* of U-shaped portion 69, the curved side wall 68, intermediate wall portion 65 and the liquid surface within lower housing 20, until it enters and moves upwardly within the vapor discharge chute C for discharge from the appliance through discharge opening 36. The volute passageway acts to cause large droplets forming to work downwards back into the reservoir/sump while only allowing fine mist particles to be carried along by the increasing air flow stream in the volute confines. The curved volute walls act to prevent heavy droplets from exiting the appliance by causing them to move along a curved wall without any direct release path. In this manner, only the fine mist particles entrained in the air stream can exit the discharge port 36. The boundary level of high pressure air that runs along the outer wall of the volute prevents the fine mist particles from reaching the wall but acts as a turn wall for those heavy droplets that pass directly between the comb teeth to strike this wall and eventually be carried down as the walls curve back into the reservoir/sump area. The vapor emitted from discharge outlet 36 will be in the form of a fine mist or fog which will provide a very effective humidification of the surrounding environment.

Figure 16A:
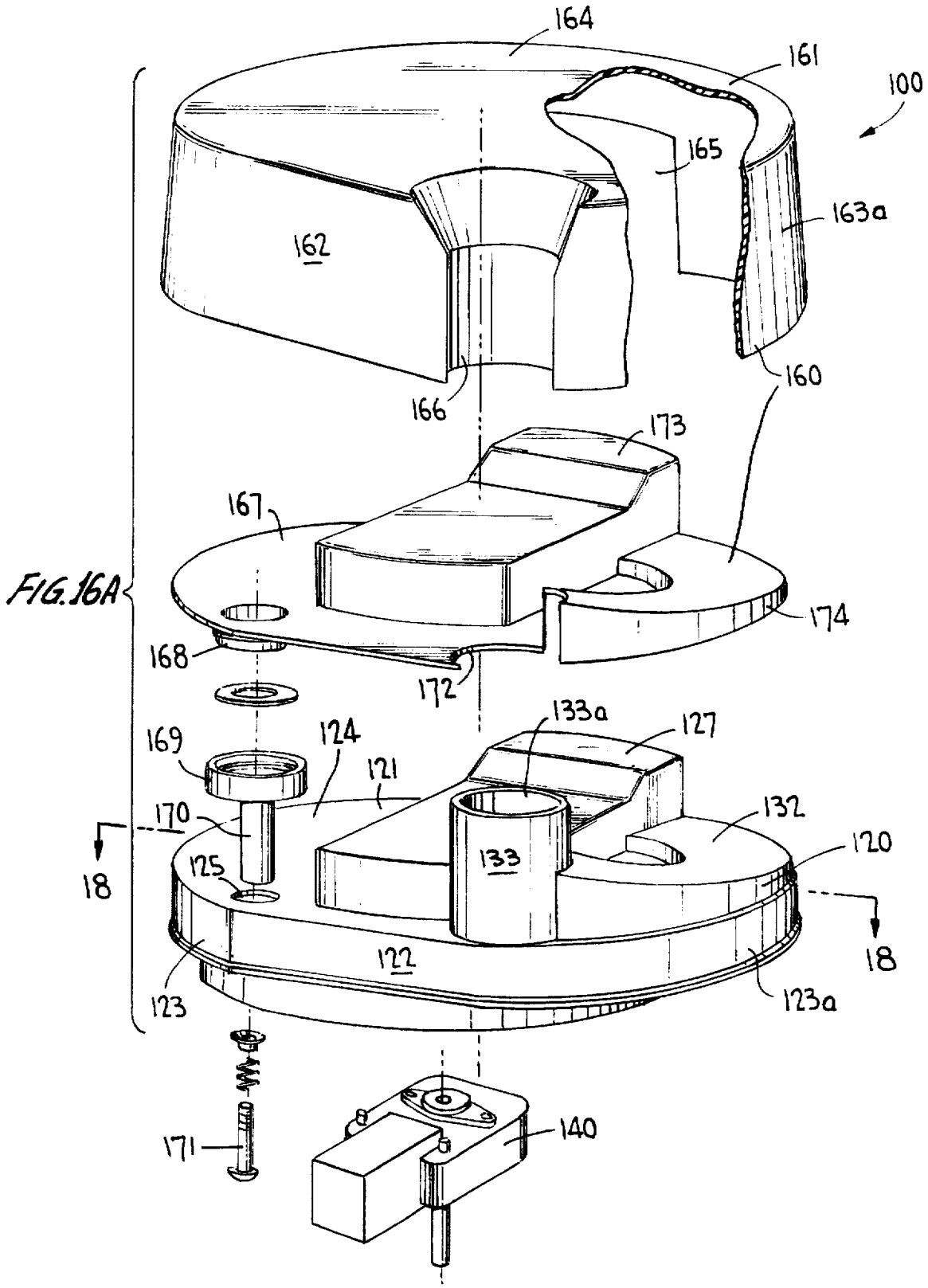
FIGS. 16A and 16B show an exploded perspective view of a coolmist-type humidifier appliance constructed in accordance with a second embodiment of the present invention, FIG. 16A showing the upper housing part (water tank) in exploded view and a portion of the intermediate housing part (vaporizer subassembly) in exploded view, and FIG. 16B showing a remaining portion of the intermediate housing part and the lower housing part (the base)
Figure 16B:
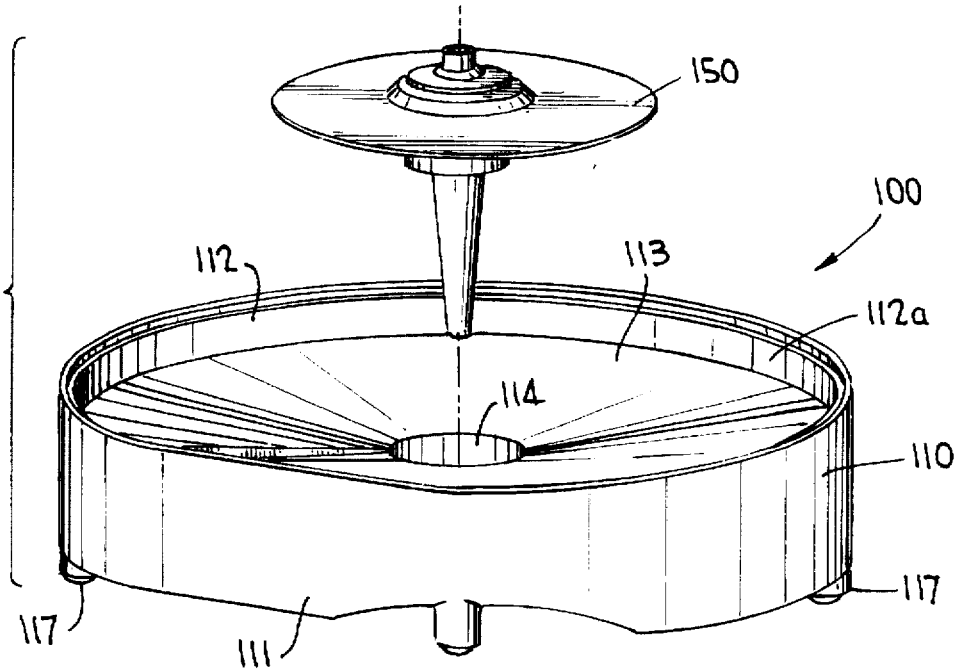
Figure 17:
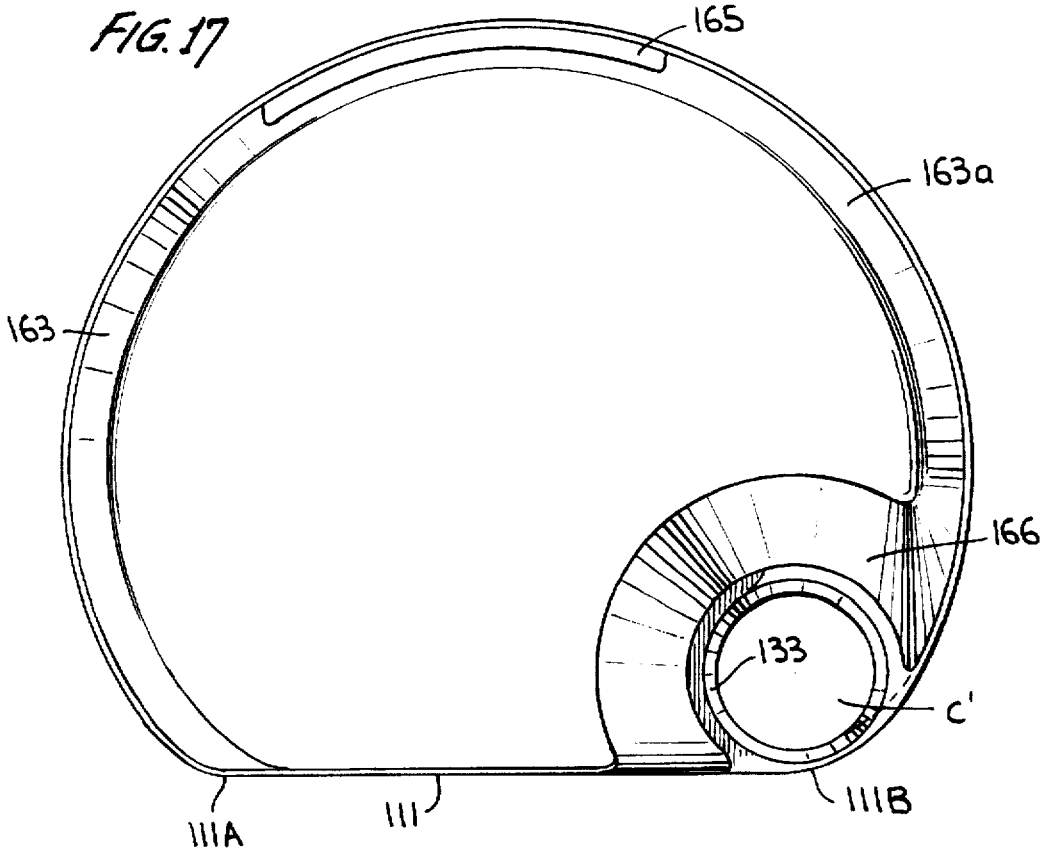
FIG. 17 is a top plan view of the humidifier appliance.

Turning now to the second preferred embodiment of humidifier appliance in accordance with the present invention, i.e., wherein the volute passageway is defined independently of a liquid surface in the appliance, this embodiment is indicated as 100 in FIGS. 16A and 16B. It is seen to include a lower housing part 110, an intermediate housing part 120 and an upper housing part 160.

Figure 22:
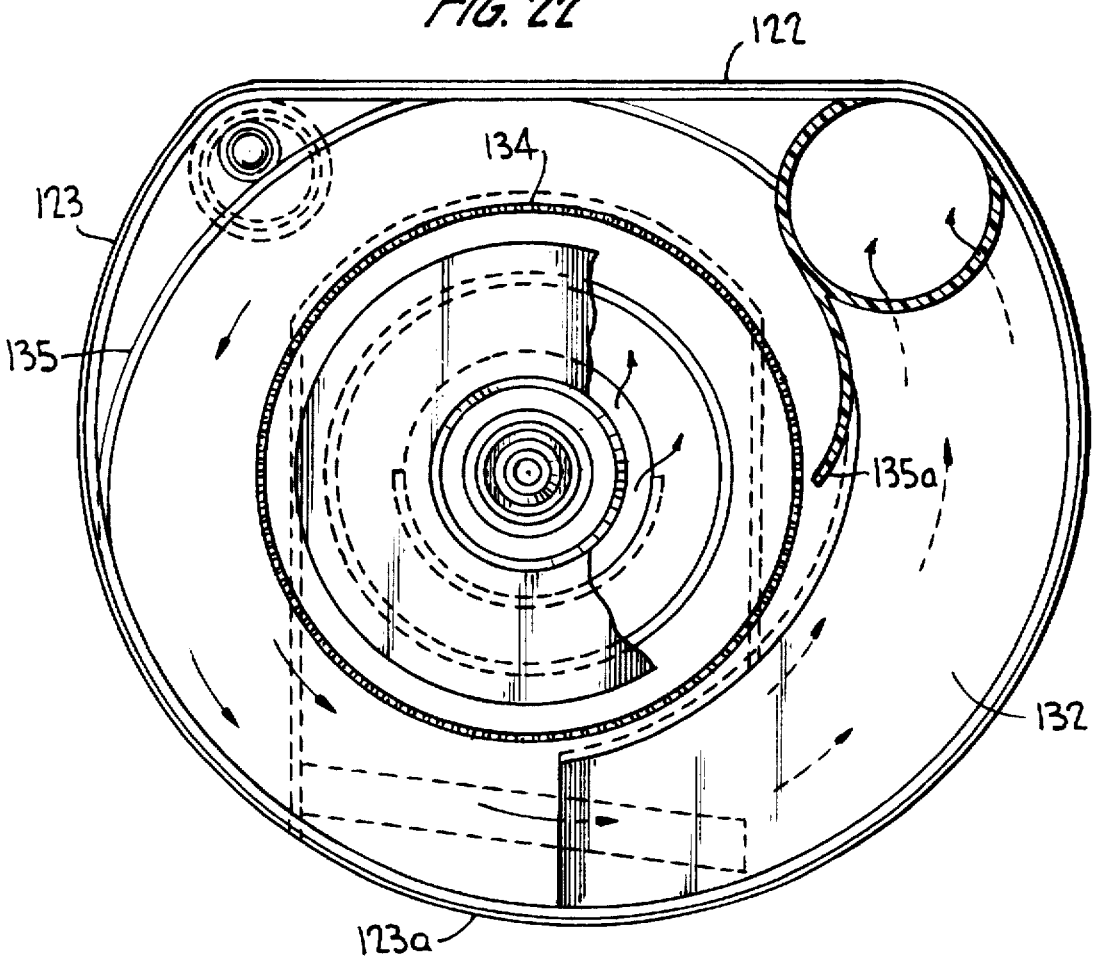
FIG. 22 is a cross sectional view of the humidifier appliance as seen along line 22—22 in FIG. 20.

The lower housing part or base 110 includes a side wall formed by a generally straight portion 111 and a curved portion 112 which extends from one end 111A of portion 111 to the other 111B, a portion 112*a* extending along a generally spiral curve. The upper edges of the portions 111 and 112 are stepped for engagement with stepped lower edges of corresponding side wall portions of the intermediate housing part. A floor 113 slopes downwardly from the sidewall to a moderately deep well 114 located offset from a center line through the base (see FIG. 22). A liquid flow channel 115 is formed in the floor 113 to extend from an area A located near the junction of side wall portions 111*a* and 112 to the well 114. A post 116 extends upwardly from the floor of flow channel 115 at area A for a purpose which will become apparent below. Feet 117 extend downwardly from the periphery of the lower housing part to position the floor 113 and well 114 above a supporting surface such as a table top.

Figure 20:
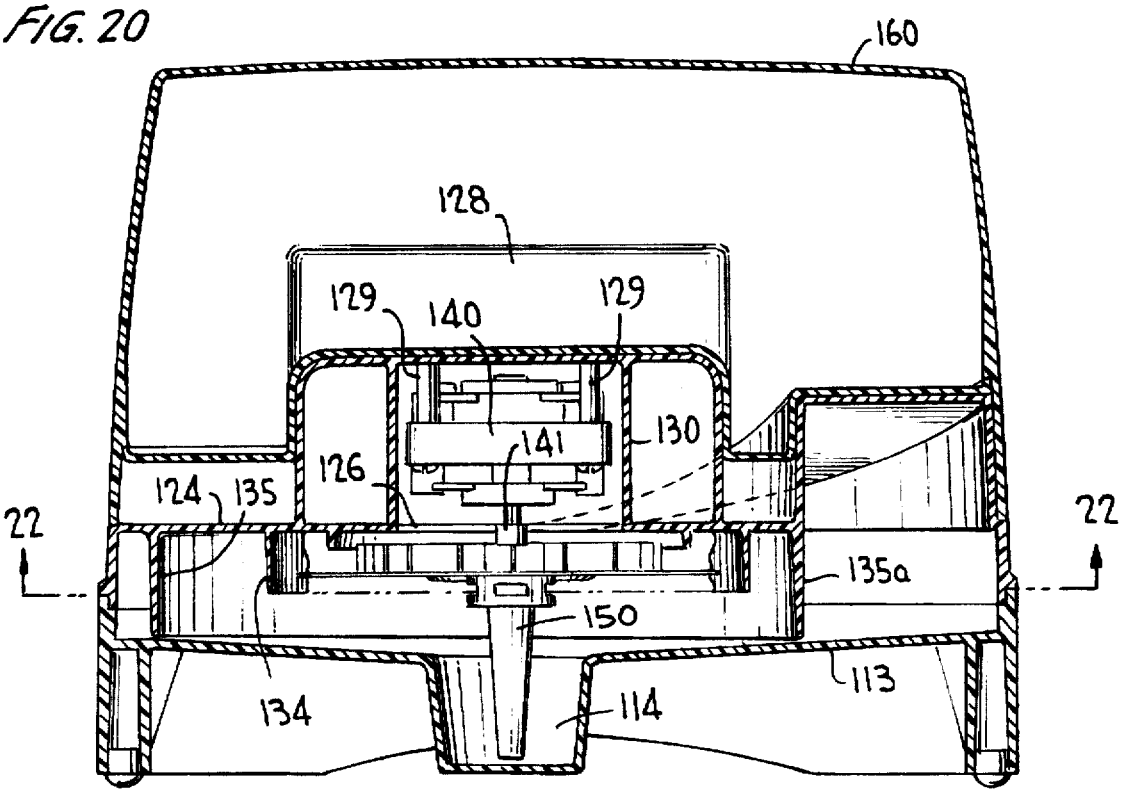
FIG. 20 is a cross sectional view of the humidifier appliance as seen along line 20—20 in FIG. 18.
Figure 21:
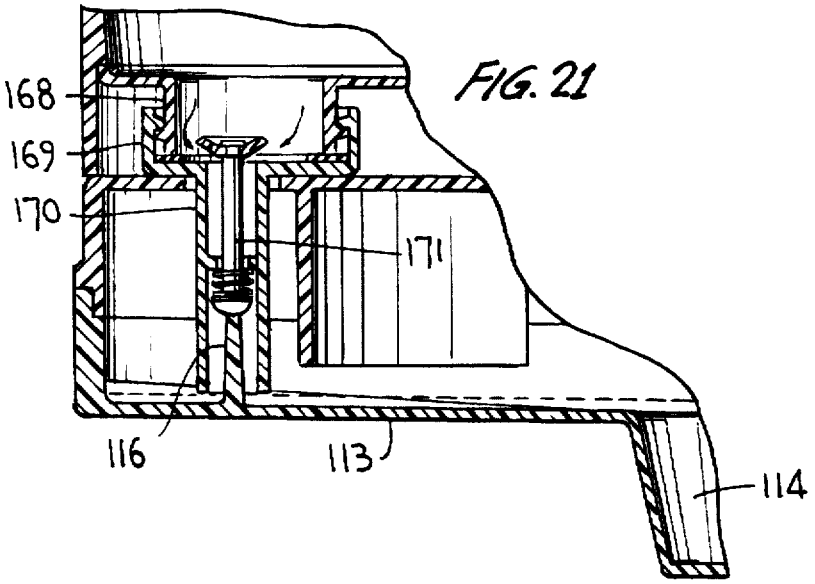
FIG. 21 is a cross sectional view of the humidifier appliance as seen along line 21—21 in FIG. 18.

The intermediate housing part or vaporizer subassembly 120 includes a hood 121, a motor 140 and an impeller assembly 150. The hood 121 includes an outer side wall formed by a generally straight portion 122 and a curved portion 123, a portion 123*a* extending along a generally spiral curve. The lower edges of these side wall portions are stepped to engage with the upper edges of the side wall portions of the base 110. The hood also includes a covering wall 124 which provides an opening 125 that is located above the post 116 of the base 110 when the subassembly 120 is positioned on the base, and an opening 126 (see FIG. 20) that is located above the well 114 when the subassembly 120 is positioned on the base. An air duct 127 is provided on top of the covering wall 124 and over the opening 126 to extend to an air inlet opening 128 at the periphery of the covering wall opposite the side wall portion 122. Motor mounts 129 are provided on the roof of the air intake duct for mounting the motor 140 therein, i.e., so that its drive shaft 141 and the impeller assembly 150 connected thereto will extend downwardly towards the well 114 along imaginary line Y. A U-shaped baffle 130 is provided in the air intake duct to cause air passing into the air intake duct through the inlet opening 128 to deflect around the motor 140 prior to passing downwardly through opening 126. A removable air filter 131 is positionable in the air intake duct 127.

The subassembly 120 also provides a curved peripheral vapor outlet ramp 132 which gradually expands upwardly from a point opposite the side wall portion 122 to a discharge nozzle 133, defining a vapor discharge opening 133*a*, the discharge nozzle 133 forming a vapor discharge chute C'. The lip of the discharge nozzle at the discharge opening 133*a* is concave in shape to allow small droplets of liquid to collect outside the ejecting air stream until the droplet mass becomes large enough to fall back into the discharge nozzle and downwardly back into the liquid reservoir. A ring 134 of comb teeth extends downwardly from the covering wall 124 around the opening 126. A curved guide wall 135 extends downwardly from the covering wall and extends from discharge nozzle 133 to the curved wall portion 123 as an increasing spiral to merge with the spiral wall portion 123*a* of outer side wall 123, and it includes a tail portion 135*a* which extends from the discharge nozzle 133 towards the ring 134 of comb teeth to help define (with ramp 132) a four-sided volute passageway portion of increasing cross sectional dimensions leading to the discharge nozzle 133 and the vapor discharge opening 133*a*. The impeller assembly 150 is similar to impeller assembly 70, although the tube thereof is shorter in length.

The upper housing part or water tank 160 includes a shroud 161 and a floor element 167. The shroud 161 includes a side wall formed by portions 162 and 163 which correspond with the portions 122 and 123 of the side wall of the subassembly 120 so as to fit thereon, and a top wall 164. The side wall portion 163 includes cut out 165 which corresponds with the opening 128 of the air inlet duct 127 of the subassembly 120, and a passageway 166 is provided for the discharge nozzle 133.

The floor element 167, which is sealingly connected within the shroud 161 so as to define a liquid reservoir R therein, provides a downwardly-extending neck 168 at a location above the area A of the base 110 and to which a removable cap 169 is attached, the cap including an elongated spout 170 containing a spring-biased poppet valve 171.

The floor element also defines an opening 172 for the discharge nozzle 133, a downwardly-open duct 173 which corresponds with the air inlet duct 127 and a downwardly-open curved channel 174 which corresponds with the curved vapor outlet: duct 132. As such, the floor element will closely fit over and against the subassembly 120, and the spout 170 of cap 169 will fit through the opening 125 so that the post 116 can fit within the spout 170 and open the poppet valve 171.

Figure 18:
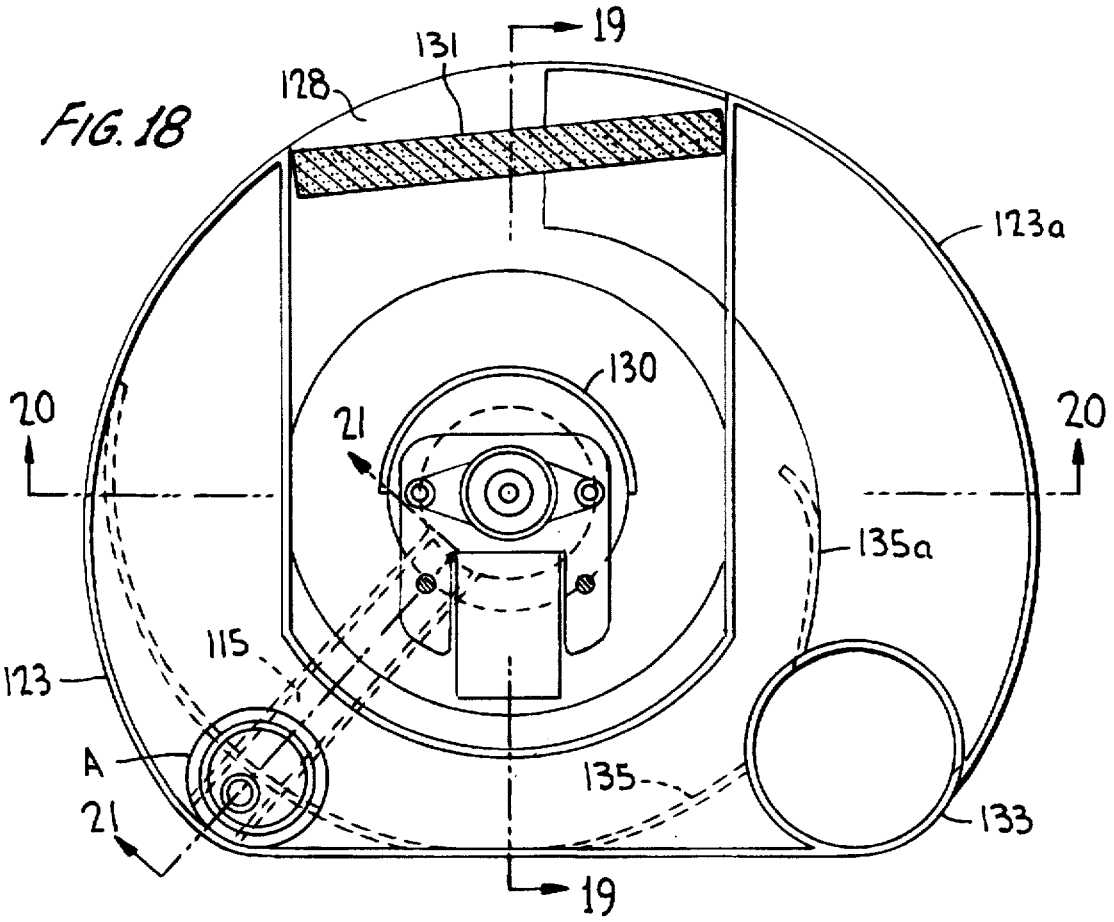
FIG. 18 is a cross sectional view of the humidifier appliance as seen along line 18—18 in FIG. 16A.
Figure 19:
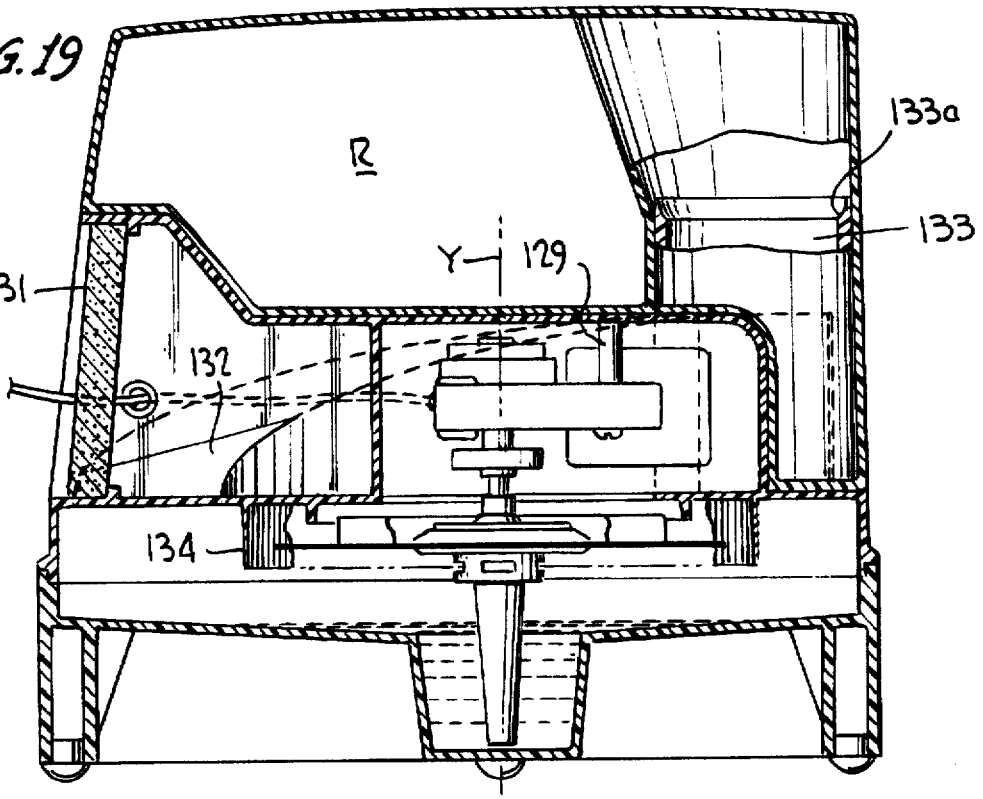
FIG. 19 is a cross sectional view of the humidifier appliance as seen along line 19—19 in FIG. 18.

In operation, with the parts of the humidifier appliance assembled together, liquid from within the water tank 160 will flow through spout 170 of the cap 169 to flow into and along channel 114 in the floor 113 of the base 110 until well 114 is generally filled. The liquid level will cover the bottom of spout 170 to prevent further liquid drainage. When motor 140 is started, the impeller assembly 150 will cause liquid to flow radially outwardly in a flow of air against the ring 134 of comb teeth to form a liquid vapor within the curved guide wall 135 and the curved outer wall portion 123*a*, which vapor will flow toward and within the three-sided volute passageway, defined first by walls 135, 124 and 113 (see FIG. 20), then walls 123*a*, 124 and 113 (see FIGS. 18 and 20), then walls 123*a*, 113 and ramp 132 (see FIG. 16A), and finally the four-sided volute passageway defined by walls 123*a*, 113, 135*a* and ramp 132 (see FIGS. 16A, 16B and 18), to the discharge nozzle 133 and through the discharge opening 133*a* out into the surrounding environment. The liquid level in well 114 and flow channel 115, which will remain constant while there is liquid in the upper housing part 160, is remote from the volute passageway and will not affect its cross sectional dimensions.

Although two preferred embodiments of the invention have been shown and described, modifications can be made therein and still fall within the scope of the present invention.

We claim:

1. A coolmist humidifier appliance for converting a liquid into a vapor without using a heater which comprises:

a first housing part for placement on a support surface and into which liquid to be vaporized can flow, said first housing part including an upwardly-extending post, a second housing part which is positionable on said first housing part and which defines a vapor discharge opening and a volute passageway of increasing cross sectional area extending toward said vapor discharge opening, said second housing including a ring of comb teeth extending downwardly toward said first housing part and a vaporizer means that includes a motor with impeller assembly for drawing liquid from said first housing part upwardly and outwardly against said ring of comb teeth to provide an air swirl of liquid mist radially outwardly of said ring of comb teeth moving along said volute passageway toward said vapor discharge opening, said second housing part defining a spout opening above the post of said first housing part, a third housing part which is positionable on said second housing part, said third housing part defining a reservoir therein for liquid to be vaporized and including a removable cap with valved spout that extends through said spout opening in said second housing part to contact said post of said first housing part to enable liquid therein to be delivered downwardly into said first housing part.

2. A coolmist humidifier appliance according to claim 1, wherein said second housing part includes an air inlet duct for passage of air to said vaporizing means.

3. A coolmist humidifier appliance according to claim 1, wherein said impeller assembly includes a tube which extends downwardly along a vertical axis, and wherein said second housing part defines a downwardly-extending guide wall which extends towards said vapor discharge opening as a spiral of increasing radius relative to said vertical axis.

4. A coolmist humidifier appliance according to claim 3, wherein said second housing part defines a curved, upwardly-extending ramp which communicates with a vertically-extending discharge nozzle that defines said vapor discharge opening and wherein said ramp forms a portion of said volute passageway.

5. A coolmist humidifier appliance according to claim 3, wherein said first housing part defines a bottom wall which defines a well into which said tube of said impeller assembly extends and a liquid channel therein which extends from said post to said well to deliver liquid from said valved spout of said third housing part to said well.

6. A coolmist humidifier appliance according to claim 3, wherein said second housing part includes a side wall having a portion which extends along a spiral curve and wherein said downwardly-extending guide wall merges with said side wall portion.

7. A coolmist humidifier appliance according to claim 1, wherein said second housing part includes a covering wall, a cylindrical discharge nozzle which extends upwardly from said covering wall to an upper end which defines said vapor discharge opening, and wherein said volute passage extends upwardly from said covering wall and increases in cross section as it curves toward said cylindrical discharge nozzle, said volute passageway communicating with said discharge nozzle via an opening in a side of said discharge nozzle.

8. A coolmist humidifier appliance according to claim 7, wherein said third housing part includes a floor element and a shroud, said floor element defining a curved channel which fits over said volute passageway, thus enabling said third housing part to snugly fit over said second housing part.

9. A coolmist humidifier appliance according to claim 8, wherein the floor element of said third housing part includes an opening to enable said cylindrical discharge nozzle of said second housing part to extend therethrough.

10. A coolmist humidifier appliance according to claim 9, wherein said shroud of said third housing part defines a passageway for the cylindrical discharge nozzle of said second housing part to extend upwardly therethrough.

* * * * *